United States Patent [19]

Dunne

[11] 4,191,029

[45] Mar. 4, 1980

[54] WATER CHILLERS AND AIR COOLED REFRIGERATION UNITS

[76] Inventor: William A. Dunne, 164 West Way, Bournemouth, Dorset, England, BH9 3DY

[21] Appl. No.: 914,429

[22] Filed: Jun. 12, 1978

[30] Foreign Application Priority Data

Jun. 21, 1977 [GB] United Kingdom ..... 25872/77

[51] Int. Cl.[2] ..... F25D 17/06

[52] U.S. Cl. ..... 62/428; 62/507; 312/257 SK; 312/257 A

[58] Field of Search ..... 62/428, 506, 507, 508, 62/426.7; 312/236, 257 SK, 257 A

[56] References Cited

U.S. PATENT DOCUMENTS

| | | | |
|---|---|---|---|
| 2,251,960 | 8/1941 | Smith | 62/428 |
| 3,299,650 | 1/1967 | Kramer | 62/507 |
| 4,045,104 | 8/1977 | Peterson | 312/257 SK |

FOREIGN PATENT DOCUMENTS

| | | | |
|---|---|---|---|
| 1246769 | 10/1960 | France | 62/428 |

*Primary Examiner*—Ronald C. Capossela
*Attorney, Agent, or Firm*—Pearne, Gordon, Sessions

[57] ABSTRACT

A water chiller and/or air cooled refrigeration unit having an upper compartment in which a fan is mounted, a condenser through which the fan draws cooling air, and, mounted beneath the condenser, other components such as a compressor with drive motor, pump and an evaporator wherein removable covers are provided for said other components, each of the removable covers comprising a generally vertical wall portion of sheet material and integral therewith a roof portion of sheet material which slopes inwardly and upwardly from the upper edge of the generally vertical wall portion, each of the covers co-operating with another similar cover on the opposite side of the unit to provide a complete roof and side walls to enclose other components beneath the condenser and fixing means to retain the covers in position. Two or more of the covers may be provided on each side of the unit. Preferably the unit has a rigid base with a generally flat upper deck mounting the other components, side panels mounted on the condenser to form a condenser unit, corner posts connectable to the corners of the deck and to the ends of the condenser unit, end panels between the pair of corner posts at each end of the unit and a rigid spine extending between said end panels and pulling said end panels inwardly, the rigid spine also mounting the fixing means for upper edges of the covers.

8 Claims, 6 Drawing Figures

FIG. 1.
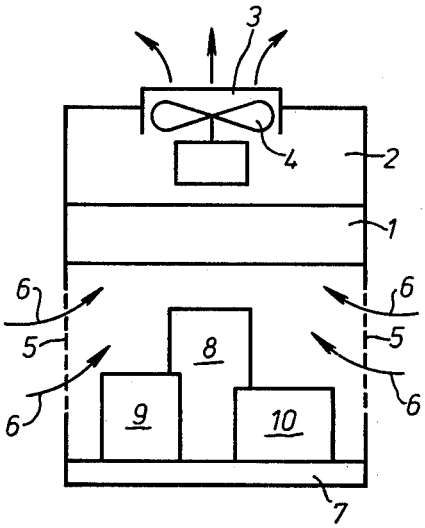
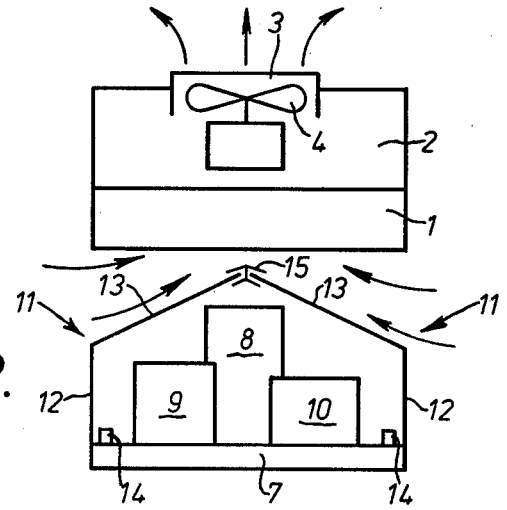
FIG. 2.

FIG. 4.
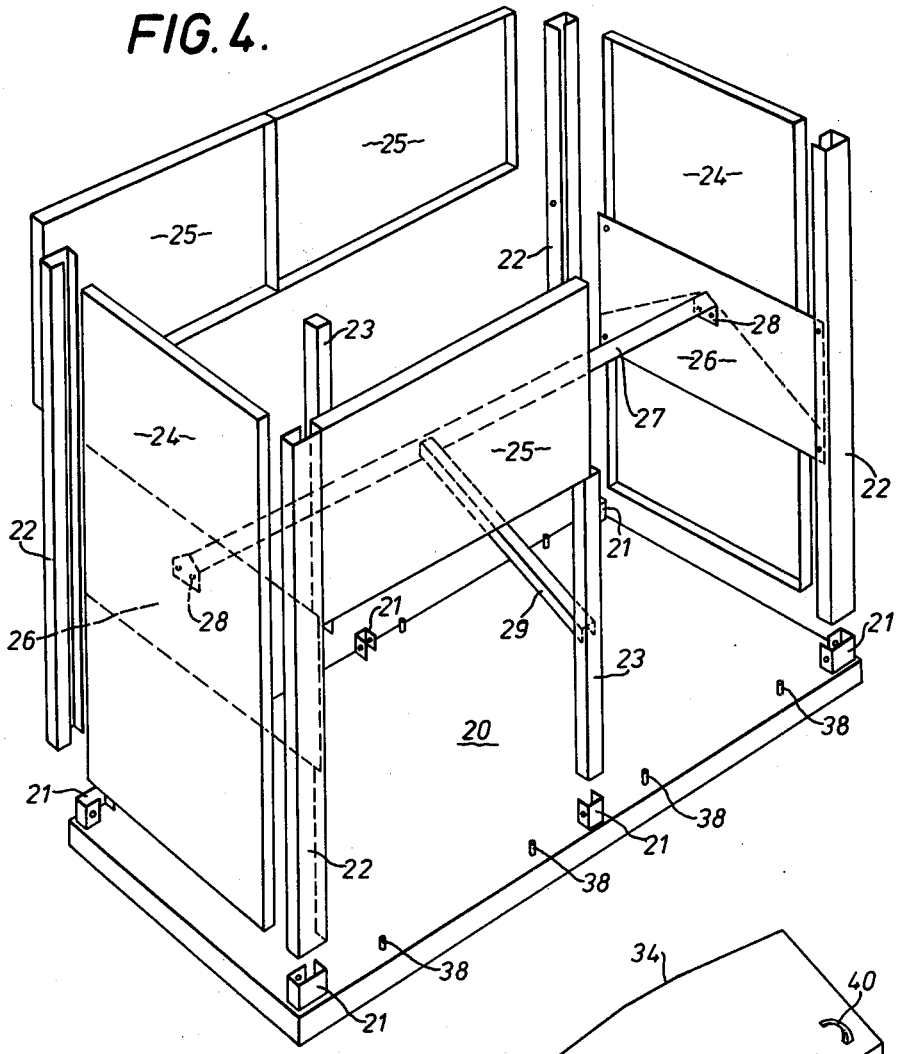
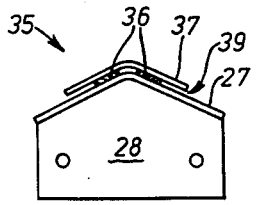
FIG. 6.
FIG. 5.
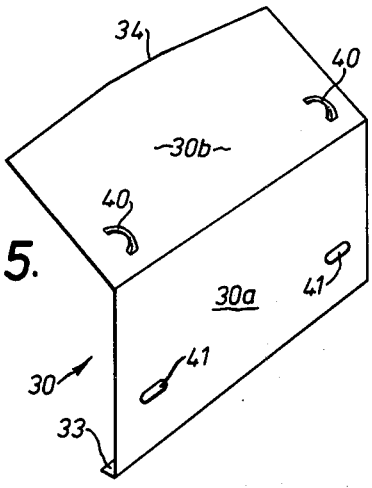

WATER CHILLERS AND AIR COOLED REFRIGERATION UNITS

The invention relates to water chillers and air cooled refrigeration units.

Such chillers and units may be used in conjunction with manufacturing apparatus or processes for example plastics moulding machinery or mixing machinery to provide cooling thereof or for use in heat exchangers for exaple for air conditioning or dehumidifying. They generally comprise an upper compartment in which a fan is mounted and which has a condenser through which the fan draws cooling air and, mounted beneath the condenser, components such as a compressor with drive motor, a pump and an evaporator. Such other components mounted beneath the condenser are frequently surrounded by side panels including louvres, grilles or meshes through which air flows to the under-side of the condenser to pass through the condenser and out through an air outlet in the upper end of the apparatus, in which air outlet the fan, which fan may be of the propellor or the axial flow type, is mounted.

Frequently such apparatus is used in relatively dirty surroundings such that air drawn upwardly through air flow passages in the condenser, deposits a certain amount of the dirt on said other components and between the fins of the condenser and such passages could eventually become clogged. The condenser can be cleaned of such dirt by blowing air from a high pressure air line through the passages in the condenser in a reverse direction to the flow of air in use, but this results in the other components located beneath the condenser becoming fouled with the dirt blow out of the passages in the condenser.

The invention has among it objects to provide a chiller unit so constructed that the other components are protected from contamination by dirt deposited at the air inlet to the condenser but are readily accessible, the flow of air to the condenser is improved whereby a lower rated fan drive motor can be used and a cabinet for the condenser is of assembled kind but is at least rigid as a comparable cabinet formed on a rigid welded framework.

According to the invention a water chiller and/or air cooled refrigeration unit of the kind referred to includes removable covers for said other components, each of the removable covers comprising a generally vertical wall portion of sheet material and integral therewith a roof portion of sheet material which slopes inwardly and upwardly from the upper edge of the generally vertical roof portion, each of said covers co-operating with another similar cover on the opposite side of the unit to provide a complete roof and side walls to enclose said other components beneath the condenser and fixing means to retain the covers in position.

Two or more of the covers may be provided, on each side of the unit, in end-to-end relation according to the length of the apparatus and the fixing means may comprise slots, angles, spigots or folded portions on the covers or in which edges of the covers engage.

The covers permit cooling air to be drawn to the under-side of the condenser without dirt in the air fouling the other components and enables dirt that collects on the under-side of the condenser or in passages in the condenser to be blown or brushed free without fouling the other components. The covers can also provide weather protection for the other components when used out-of-doors and can assist free flow of air to the under-side of the condenser.

The water chiller and/or air cooled refrigeration unit may have a rigid base with a generally flat upper deck mounting said other components, side panels mounted on the condenser to form a condenser unit, corner posts connectable to the corners of the deck and to the ends of the condenser unit, end panels between the pair of corner posts at each end of the cabinet and a rigid spine extending between said end panels and pulling said end panels inwardly, said rigid spine also mounting said fixing means for the upper edges of the covers.

Preferably the ends of the rigid spine are coupled to inner end panels extending parallel to said end panels with said inner end panels also coupled to the corner posts and, where two or more covers are provided in end-to-end relation on the same side of the unit, a vertical mullion is or vertical mullions are provided intermediate the ends of the or each vertical mullion and a position or positions intermediate the ends of the rigid spine.

The corner posts and, where provided, the vertical mullions are preferably coupled to the deck by means of upstands welded to the deck to project upwardly therefrom, the corner posts and vertical mullions engaging over said upstands and being bolted thereto.

The fixing means to retain the covers in position preferably include upstanding spigots from the deck adjacent the side edges thereof to engage in apertures in a base flange turned inwardly at the lower edge of the side wall of each of the covers and a slot provided between the rigid spine and a member overlying the rigid spine, the upper edge of the roof portion of each cover preferably being bowed between its ends such that when downward pressure is applied to the roof portion of the cover the bow is straightened so that the leading edge of the cover can be engaged in said slot, the resilience of the roof portion of the cover attempting to return it to its bowed configuration within the slot and thereby retaining the upper edge of the roof wall of the cover within the slot.

Handles on and/or apertures in the covers may be provided to enable them to be gripped and disengaged from the fixing means to permit removal from the unit to allow access to said other components, for example for service.

The invention is diagrammatically illustrated by way of example in the accompanying drawings, in which:

FIG. 1 is a schematic outline of a water chiller and air cooled refrigeration unit of previously proposed kind;

FIG. 2 is a schematic outline of a water chiller and air cooled refrigeration unit according to the invention;

FIG. 4 is an exploded view of the cabinet of the water chiller and/or refrigeration unit of FIG. 3;

FIG. 5 shows a cover panel of the cabinet of FIG. 4; and

FIG. 6 shows a tie bar ridge assembly of the cabinet of FIG. 4.

Figure 3:
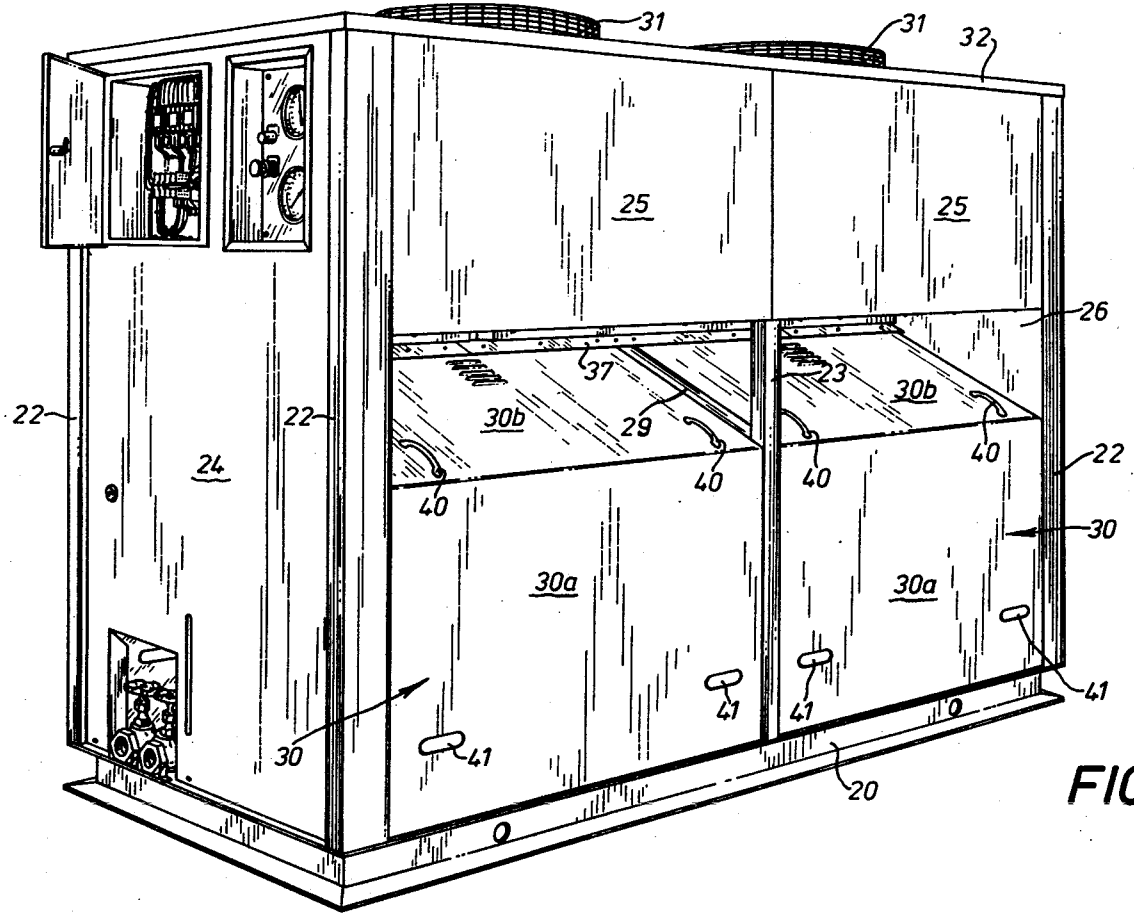
FIG. 3 is a perspective view of a water chiller and/or air cooled refrigeration unit according to the invention.

Referring to FIG. 1, a condenser 1, in which a refrigerant in vapour form can be condensed to liquid form, is contained in a plenum chamber 2 having an air outlet 3 with a fan 4 mounted therein. The action of the fan 4 draws air through grilles 5, as indicated by arrows 6, and through the condenser 1 to pass outwardly through the air outlet 3, the flow of air through the condenser 1 condensing refrigerant in vapour form fed thereto by feed and return pipes not illustrated. Mounted on a base 7 of the apparatus and beneath the condenser 1 are a pump 8, an evaporator 9 and a compressor 10. Unless the grilles 5 are a very fine mesh, the air drawn through the condenser 1 is likely to be dirt-laden and some of the dirt from the air will be deposited on the components 8, 9 and 11 and some will be deposited in the air flow passages in the condenser 1. Reverse-flow blowing-out of the air flow passages in the condenser 1 or brushing of the under-side of the condenser, will deposit further dirt on the components 8, 9 and 10 probably with a detrimental effect upon their operation. Providing the grilles 5 of fine mesh has proved to be impractical since not only does it necessitate a more powerful fan 4, due to the higher resistance of the fine mesh grilles to air flow, but necessitates more frequent removal and cleaning of the fine mesh grilles 5 than they are likely to receive in practice.

Referring to FIG. 2, in which like components to those shown in FIG. 1 are given like reference numerals, the grilles 5 are preferably omitted altogether and, on each side of the apparatus, a cover 11 is provided. Each cover 11 comprises a generally vertical portion 12 and an integral sloping portion 13 which slopes inwardly and upwardly from the upper edge of the portion 12, pairs of opposed covers 11 co-operating to form a complete roof and side walls for the components 8 to 10.

Retaining means for the covers 11 may take various forms but as shown comprise slots, angles, spigots and/or folded sections 14 at the lower edges of the vertical portions 12 and a double grooved member 15 into the grooves in the opposite sides of which upper edges of the sloping portions 13 engage.

An operator can relatively easily remove one of the covers 11 by lifting the vertical portion clear of the retaining device, for example by means of a handle or finger holes and grasping the cover, for example by handles (not shown) provided on the sloping portion 13 and pulling the cover 11 outwardly, the flexibility of the cover at the fold between the portions 12 and 13 allowing dis-engagement from the member 15 and free outward movement of the cover 11 to permit access to the components 8, 9 and 10.

The covers 11 are preferably formed of sheet metal, for example coated sheet steel or sheet aluminum, but may if desired by formed of other materials, for example of a thermoplastics material.

Referring to FIGS. 3 to 6, a rectangular base 20 for a cabinet of the apparatus is formed as a rigid unit with a welded frame and a flat upper deck and has upstands 21 at the corners and at mid-positions in each of the two long sides. The upstands 21 are formed by heavy gauge sheet steel, for example 3 mm thick and are welded (on their inside edges only) to the base 20. The upstands 21 at each corner can each receive a corner post 22 and the others each a vertical mullion 23, side faces of the upstands having apertures therein with captive nuts on the inner faces for bolting the corner posts 22 and vertical mullions 23 to the upstands 21.

Fixed end panels 24 and side panels 25 are folded to form 90° flanges at their edges, which flanges are drilled or punched or form apertures so that they can be bolted to others of the panels, the corner posts 22 and the mullions 23 which are correspondingly punched or drilled.

After said other components to be mounted on the base 20 have been mounted thereon and the various connections made, the end panels 24 are bolted to the corner posts 22, which corner posts 22 are then pushed onto the corner upstands 21 and bolted to them, the bolts extending inwardly so as not to be visible when the cabinet assembly is completed.

A rectangular condenser (not shown) which has an area similar to that between the corner posts 22 is positioned between the top and bottom flanges of the side panels 25 and flanges at the bottom of the long sides of the rectangular condenser are bolted to the bottom flanges of the fixed side panels 25.

The side panels 25, containing and secured to the condenser, are then bolted to the corner posts 22.

The vertical mullions 23, which each have a 90° flange formed on the top that is to say closing-off the top end, are engaged with the mid-position upstands 21 and bolted to them and the 90° top flanges are bolted to the bottom flanges of the side panels 25.

End tie panels 26 are bolted to the inside faces of the corner posts 22. The panels 26 may have flanges on their edges with the top flange thereof folded inwards and secured to flanges at the bottom of the short sides of the rectangular condenser.

A tie bar 27 is constructed from heavy gauge steel, for example 3 or 5 mm thick, with an angular cross-section and downturned end flanges 28. The overall length of the tie bar 27 is slightly less than the clear distance between the end tie panels 26.

The tie bar 27 is bolted to the end tie panels 26 and when nuts on the bolts are tightened, the end panels 26 and the corner posts 22 secured thereto are pulled inwardly. The upper part of the cabinet is rigid due to the condenser to which it is bolted, the lower part is rigid due to the rigid base 20 and the inward pull applied by the bolts of the tie bar 27 acting on the end tie panels 26 and thus on the corner posts 22 to which the end tie panels 26 are bolted, causes the whole cabinet to be pulled taut and rigid.

Cross mullions 29 are bolted to the vertical mullions 23 and to the tie bar 27. The cross mullions 29 have upturned flanges (not shown) at the lower edges to provide weather protection at their joint with cover panels 30 (FIG. 5), corresponding to the covers 11 of FIG. 2, and allow any water to run down clear of the components mounted on the base 20 beneath the cover panels 30.

Fans 31 are fitted to a top panel 32 or top panels (FIG. 3) which are flanged and, if more than one is provided, joined together in a similar manner to the jointing together of the side panels 25 and are fitted externally over the top of the corner posts 22, the end panels 24 and the side panels 25, to which they are bolted.

The movable cover panels 30 are each formed with an intermediate fold to form a side wall **30*a* and sloping roof wall 30*b* with a fold to form a base flange 33. They may also have flanges on all the edges except the upper leading edge 34 which engages with a ridge assembly 35 (FIG. 6) of the tie bar 27, which ridge assembly is formed by fixing together the tie bar 27, packing pieces 36 and a ridge cover plate 37**.

The cover panels 30 are formed with a slight 'bow' at the upper leading edge 34 which upper edge 34 is cut-away slightly on each side.

When the cover panels 30 are assembled with the cabinet, holes in the base flange 33 of each cover panel 30 engage with projecting spigots 38 on the base 20 and the leading edge 34 rests on the outer area of the tie bar 27 with the centre part of the leading edge 34 approximately in the same plane as the ridge cover plate 37 due to the 'bow' in the leading edge 34.

To engage each cover panel 30 fully, the centre part of the leading edge 34 is pushed downwards so that it lies flat on the tie bar 27 and the whole cover panel 30 is pushed inwards so that the leading edge 34 engages in a gap 39 (FIG. 6) between the tie bar 27 and the ridge cover plate 37.

The cover panels 30 are removed by pulling them outwards clear of the ridge cover plate 37 by means of handles 40 on the cover panels 30 and lifting them off the spigots 38 by the operator engaging his hands in apertures 41 in the cover panels 30.

The corner posts 22, the mullions 23, the pnales 24, 25, 26 and 30, the packing pieces 36 and the ridge cover plate 37 are constructed from lighter gauge sheet metal than the upstands 21, for example 1.5 mm thick.

The construction of the cabinet outlined above can result in a cabinet which can be at least as rigid as a conventional welded frame cabinet, with the advantages of lower manufacturing costs and lower transportation and storage costs of the components which can be stacked and nested to use a relatively small space prior to assembly. The tie bar 27 has the dual function of pulling the cabinet taut and rigid and also retaining in position the leading edges 34 of the upper ends of the cover panels 30. The bowed leading edge 34 of each cover panel 30 enables each cover panel 30 to be fitted and removed very quickly yet securely retained against rattle due to vibration without the need for fixing screws or other fasteners.

What is claimed is:

1. A chiller unit comprising means defining a main frame having an upper compartment, a fan mounted in said compartment, a condenser through which said fan drawns cooling air mounted in said compartment, and other components mounted beneath said condenser and in said main frame, removable covers for said other components, each of said removable covers comprising a generally vertical wall portion of sheet material, and, integral therewith, a roof portion of sheet material which slopes inwardly and upwardly from the upper edge of said generally vertical wall portion, each of said covers cooperating with another similar cover on the opposite side of the unit to provide a complete roof and side walls to enclose said other components beneath said condenser, and fixing means to retain said covers in position.

2. A chiller unit as claimed in claim 1, having on each side of the unit, two of said covers in end-to-end relation.

3. A chiller unit as claimed in claim 1, including a rigid base with a generally flat upper deck mounting said other components, side panels mounted on said condenser to form a condenser unit, said main frame including corner posts connected to the corners of said deck and to the ends of said condenser unit, end panels between the pair of said corner posts at each end of the unit and a rigid spine extending between said end panels and pulling said end panels inwardly, said rigid spine also mounting said fixing means for upper edges of said covers.

4. A chiller unit as claimed in claim 3, having on each side of the unit, two of said covers in end-to-end relation, and wherein the ends of said rigid spine are coupled to inner end panels extending parallel to said end panels with said inner end panels also coupled to said corner posts, wherein a vertical mullion is provided intermediate the ends of said deck on each side thereof and generally aligned with the two of said corner posts disposed on that side of said deck, and wherein a cross mullion is coupled between a position intermediate the ends of said vertical mullion and a position intermediate the ends of said rigid spine.

5. A chiller unit as claimed in claim 4, wherein said corner posts and said vertical mullions are coupled to said deck by means of upstands welded to said deck to project upwardly therefrom, said corner posts and said vertical mullions engaging over said upstands and being bolted thereto.

6. A chiller unit as claimed in claim 3, wherein said fixing means to retain said covers in position include upstanding spigots from said deck adjacent the side edges thereof to engage in apertures in a base flange turned inwardly at the lower edge of said wall portion of each of said covers, a member is provided overlying said rigid spine and forming a slot therebetween, said upper edge of said roof portion of each cover is bowed between its ends such that when downward pressure is applied to said roof portion of said cover the bow is straightened so that said leading edge of said cover can be engaged in said slot, the resilience of the roof portion of said cover attempting to return it to its bowed configuration within said slot and thereby retaining said upper edge of said roof portion of said cover within said slot.

7. A chiller unit as claimed in claim 1, further comprising handles on said covers to enable them to be gripped and disengaged from said fixing means to permit removal from said unit.

8. A chiller unit as claimed in claim 1, wherein said covers are formed with apertures therein to permit them to be gripped and disengaged from said fixing means to permit removal from the unit.

* * * * *